US010045101B1

(12) United States Patent
Hsu

(10) Patent No.: US 10,045,101 B1
(45) Date of Patent: Aug. 7, 2018

(54) GROUND INSERT SOUND

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: DONG GUAN JIA SHENG LIGHTING TECHNOLOGY CO., LTD. CHINA, Dong-Guna, Guang Dong (CN)

( * ) Notice: Subject to any disclaimer, the term of this patent is extended or adjusted under 35 U.S.C. 154(b) by 0 days.

(21) Appl. No.: 15/712,245

(22) Filed: Sep. 22, 2017

(51) Int. Cl.
*H04R 1/02* (2006.01)

(52) U.S. Cl.
CPC ..... *H04R 1/02* (2013.01)

(58) Field of Classification Search
CPC ..... H04R 1/345
See application file for complete search history.

(56) References Cited

U.S. PATENT DOCUMENTS 4,451,019 A * 5/1984 Bensel ..... A47B 96/1425 248/694
7,066,613 B2 * 6/2006 Vishwamitra ..... A63J 17/00 362/343
7,889,505 B1 * 2/2011 Beard ..... H04R 1/025 361/730
9,668,053 B1 * 5/2017 Rivera ..... H04R 3/12
2004/0118630 A1 * 6/2004 Harwood ..... H04R 1/323 181/199
2006/0126860 A1 * 6/2006 Sievers ..... F21V 21/0824 381/77
2010/0192999 A1 * 8/2010 Li ..... A45B 3/02 135/96
2013/0083537 A1 * 4/2013 Harwood ..... F21V 33/0076 362/253
2014/0050345 A1 * 2/2014 Hilderman ..... H04R 1/026 381/332
2017/0013337 A1 * 1/2017 Costello ..... H04R 1/028
2017/0311062 A1 * 10/2017 Garrett ..... H04R 1/028

* cited by examiner

*Primary Examiner* — Mohammad Islam
(74) *Attorney, Agent, or Firm* — Alan D. Kamrath; Kamrath IP Lawfirm, P.A.

(57) ABSTRACT

A ground insert sound includes a stake, a support rod mounted on the stake, and a sounding assembly mounted on the support rod. The sounding assembly includes a base mounted on the support rod, a sound guide unit mounted on the base, a speaker module mounted on the sound guide unit, an outer shell mounted on and located outside of the speaker module, a circuit board mounted in the base, and a battery mounted in the base. The circuit board is connected electrically with the speaker module by conducting wires. The battery is connected electrically with the circuit board by conducting wires.

8 Claims, 5 Drawing Sheets

GROUND INSERT SOUND

BACKGROUND OF THE INVENTION

1. Field of the Invention

The present invention relates to a sound and, more particularly, to a ground insert sound.

2. Description of the Related Art

A conventional sound system is often used indoors to provide a stereo amusement effect. However, when the conventional sound system is used outdoors, it is only placed on the ground and is not positioned steadily, so that the conventional sound system is easily worn out or get wet. Another conventional sound system is mounted in a suspension manner. However, the mounting procedures are complicated, thereby causing inconvenience to the user when assembling or disassembling the sound system.

BRIEF SUMMARY OF THE INVENTION

The primary objective of the present invention is to provide a ground insert sound that is mounted on the ground easily and quickly.

In accordance with the present invention, there is provided a ground insert sound comprising a stake, a support rod mounted on the stake, and a sounding assembly mounted on the support rod. The sounding assembly includes a base mounted on the support rod, a sound guide unit mounted on the base, a speaker module mounted on the sound guide unit, an outer shell mounted on and located outside of the speaker module, a circuit board mounted in the base, and a battery mounted in the base. The circuit board is connected electrically with the speaker module by conducting wires. The battery is connected electrically with the circuit board by conducting wires.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
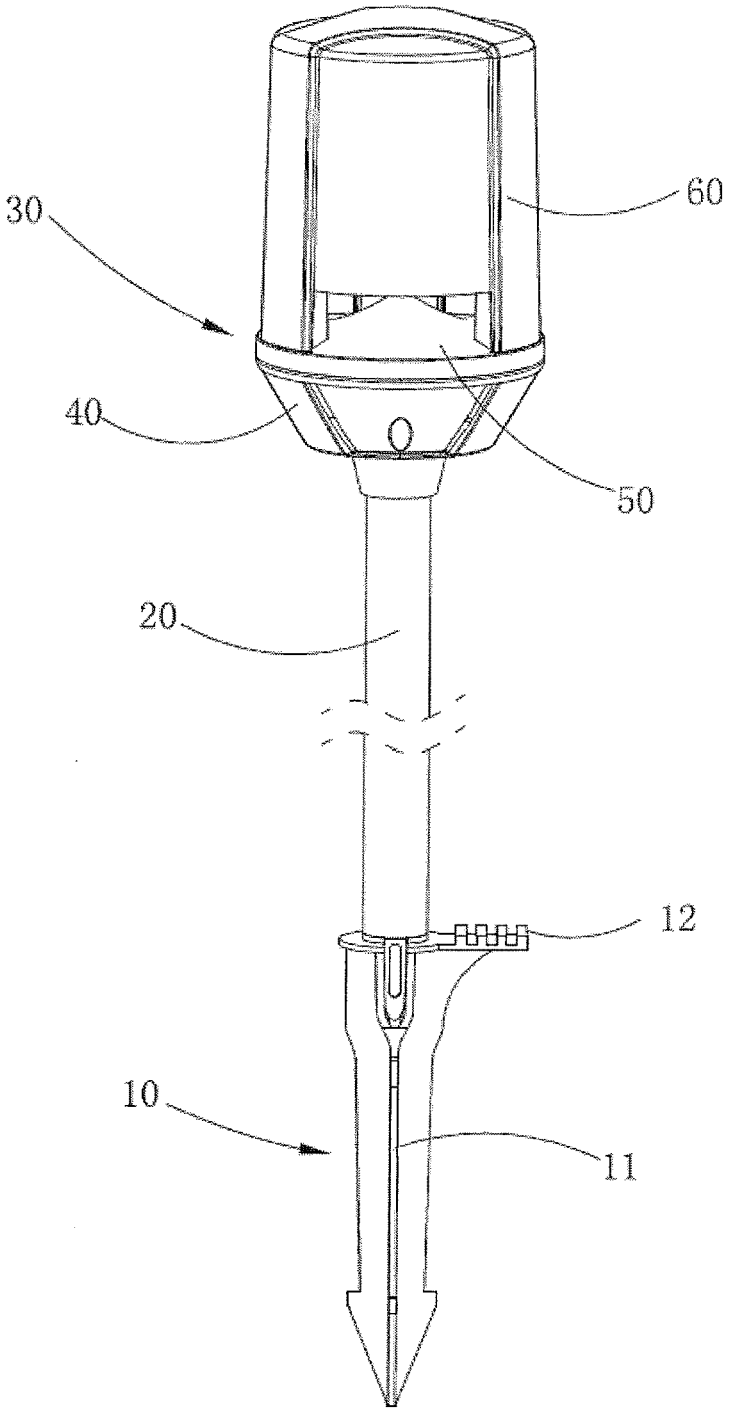
FIG. 1 is a perspective view of a ground insert sound in accordance with the preferred embodiment of the present invention.
Figure 2:
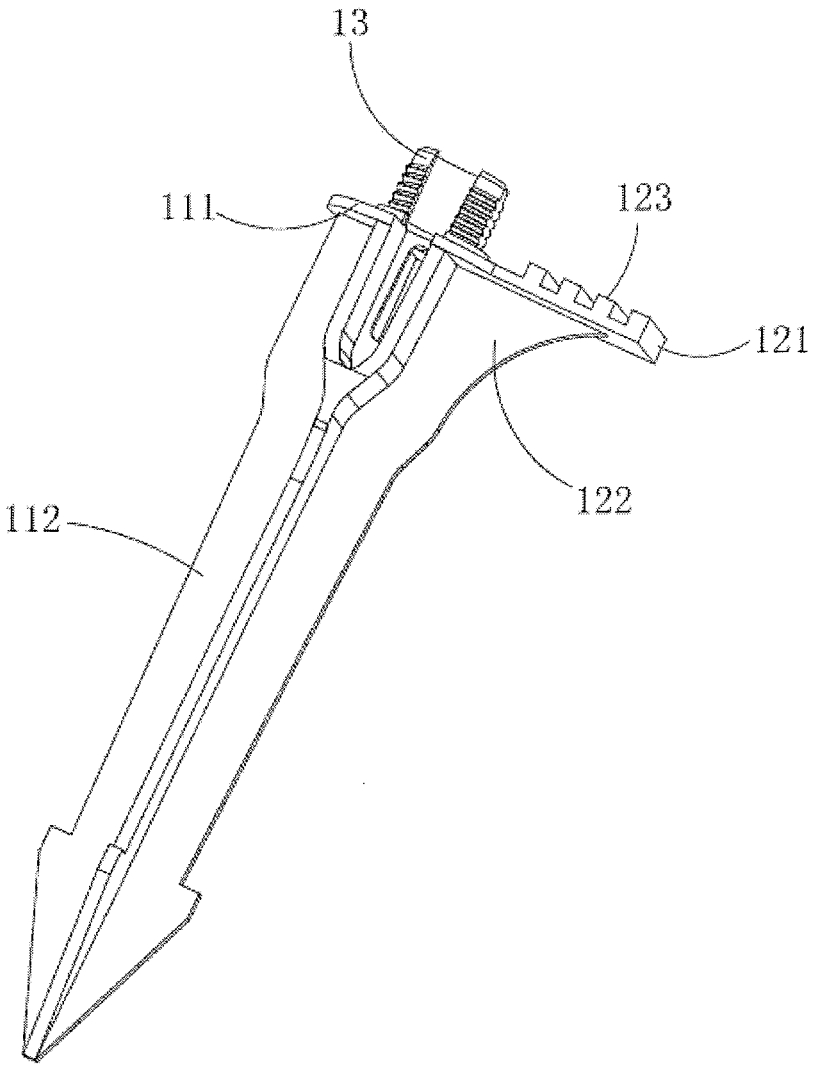
FIG. 2 is a perspective view of a stake of the ground insert sound in accordance with the preferred embodiment of the present invention.
Figure 3:
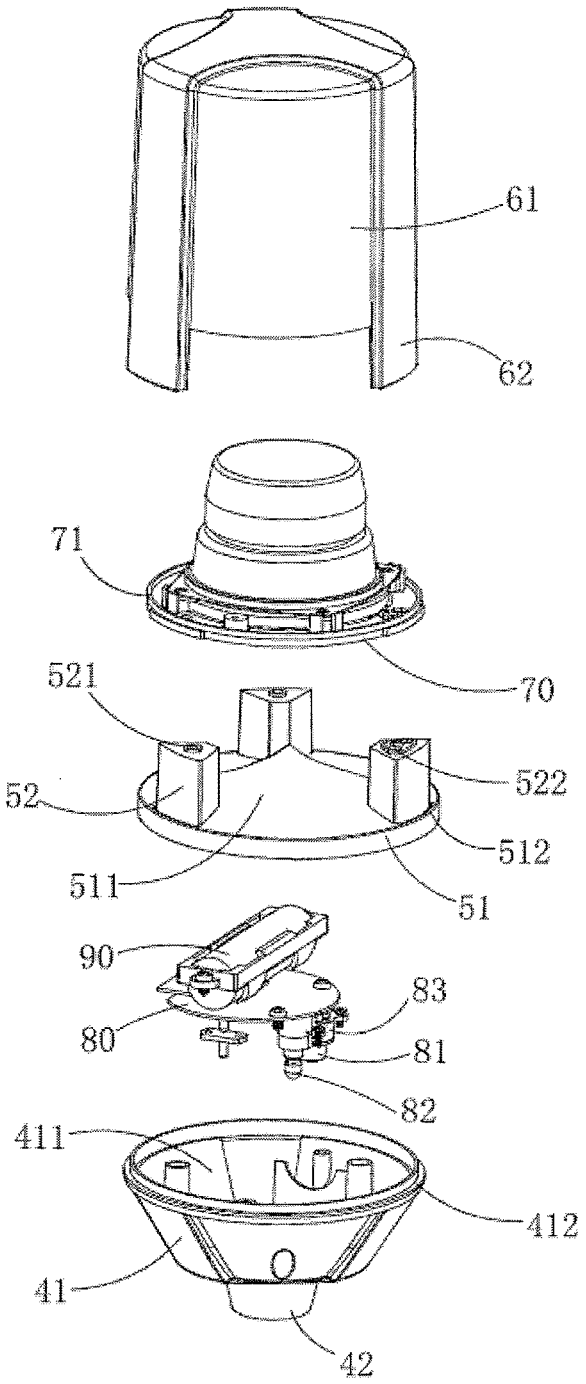
FIG. 3 is an exploded perspective view of a sounding assembly of the ground insert sound in accordance with the preferred embodiment of the present invention.
Figure 4:
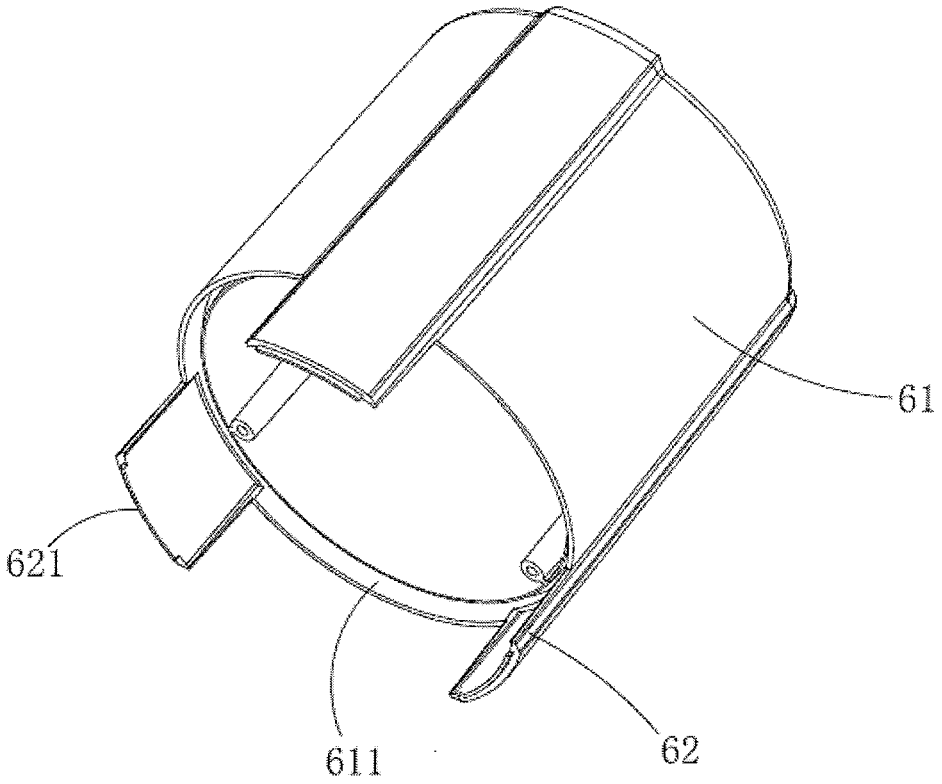
FIG. 4 is a perspective view of an outer shell of the ground insert sound in accordance with the preferred embodiment of the present invention.

Referring to the drawings and initially to FIGS. 1-4, a ground insert sound in accordance with the preferred embodiment of the present invention comprises a stake 10, a support rod 20 mounted on the stake 10, and a sounding assembly 30 mounted on the support rod 20. The stake 10 is inserted into the earth.

The sounding assembly 30 includes a base 40 mounted on the support rod 20, a sound guide (or transmission) unit 50 mounted on the base 40, a speaker module 70 mounted on the sound guide unit 50, an outer shell 60 mounted on and located outside of the speaker module 70, a circuit board 80 mounted in the base 40, and a battery 90 mounted in the base 40. The circuit board 80 is connected electrically with the speaker module 70 by conducting wires. The battery 90 is connected electrically with the circuit board 80 by conducting wires.

In the preferred embodiment of the present invention, the base 40 includes a main portion 41 and a mounting tube 42 mounted on a bottom of the main portion 41. The mounting tube 42 is provided with an internal thread. The sound guide unit 50 includes a reflective portion 51 mounted on the main portion 41 of the base 40 and a plurality of support posts 52 mounted on the reflective portion 51.

In the preferred embodiment of the present invention, the main portion 41 of the base 40 has a top having a periphery provided with an annular retaining groove 412, and the reflective portion 51 of the sound guide unit 50 has a bottom provided with an annular retaining edge retained in the retaining groove 412 of the base 40.

In the preferred embodiment of the present invention, the circuit board 80 is provided with a switch 81, a plurality of match buttons 83, and a switching button 82. The main portion 41 of the base 40 is provided with a receiving recess 411 which has a bottom wall provided with a plurality of through holes. The switch 81, the match buttons 83 and the switching button 82 extend through and protruding from the through holes of the base 40.

In the preferred embodiment of the present invention, the reflective portion 51 of the sound guide unit 50 has a conical arrangement and is provided with a conical divergence face 511 to diverge the sound. The support posts 52 of the sound guide unit 50 are arranged and distributed evenly around a center of the conical divergence face 511. Each of the support posts 52 has a height greater than that of the reflective portion 51. The speaker module 70 is provided with a speaker diaphragm corresponding to the conical divergence face 511 of the sound guide unit 50.

In the preferred embodiment of the present invention, at least one of the support posts 52 is provided with a wire hole 522 extending therethrough. The conducting wires of the speaker module 70 pass through the wire hole 522 into the base 40 and connect the circuit board 80.

In the preferred embodiment of the present invention, each of the support posts 52 has a top provided with a screw hole 521, and the sounding assembly 30 further includes a plurality of set screws each extending through the speaker module 70 and each screwed into the screw hole 521 to affix the speaker module 70 to the support posts 52 of the sound guide unit 50.

In the preferred embodiment of the present invention, the outer shell 60 includes a shell body 61 and a plurality of side plates 62 connected with and located outside of the shell body 61. The shell body 61 has a barrel shape and has an opening directed downward. The shell body 61 has a lower end provided with a first locking groove 611. The side plates 62 are located outside of and cover the support posts 52 respectively. Each of the side plates 62 has a lower end protruding from the shell body 61 and provided with a first locking piece 621. The speaker module 70 is provided with a second locking piece 71 locked into the first locking groove 611 of the shell body 61. The sound guide unit 50 is provided with a second locking groove 512 locked onto the first locking piece 621 of each of the side plates 62.

In the preferred embodiment of the present invention, the stake 10 includes an insert 11, a pedal 12 mounted on an upper end of the insert 11, and a mounting head 13 mounted on the upper end of the insert 11. Preferably, the insert 11, the pedal 12 and the mounting head 13 are formed integrally. The insert 11 includes a pedestal 111 and a plurality of upright plates 112 extending downward from the pedestal 111 and arranged in a radiating manner. The pedestal 111 has a disk shape. Each of the upright plates 112 has a bottom having a tapered shape, with a vertical distance between an outer edge of the bottom of each of the upright plates 112 and a central axis of the insert 11 increasing gradually from bottom to top. Thus, the insert 11 has a conic pointed bottom that is inserted into the earth easily. The pedal 12 includes a platform 121, an oblique plate 122 connecting the platform 121 and the insert 11, and a plurality of ribs 123 mounted on a top of the platform 121 to increase the friction. The platform 121 is juxtaposed to and connected with the pedestal 111. The mounting head 13 is mounted on the pedestal 111 of the insert 11. The mounting head 13 has a hollow arrangement and is provided with an external thread. The support rod 20 has a first end connected with the mounting tube 42 and a second end connected with the mounting head 13.

In the preferred embodiment of the present invention, the sounding assembly 30 further includes a receiver, a transmitter and a decoder. The receiver receives an external audio signal, the decoder decodes the audio signal, and the transmitter transmits the audio signal that has been decoded.

In the preferred embodiment of the present invention, the ground insert sound is used individually. Alternatively, multiple ground insert sounds are combined and cooperate with each other.

Figure 5:
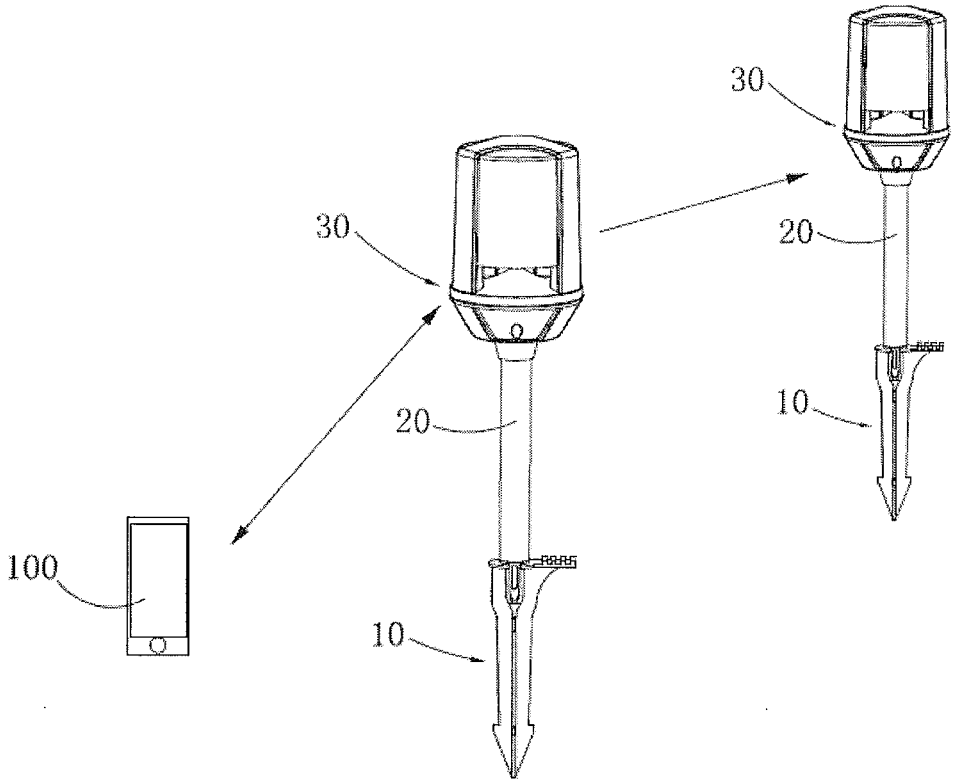
FIG. 5 is a schematic operational view of two ground insert sounds in accordance with the preferred embodiment of the present invention.

In use, referring to FIG. 5 with reference to FIGS. 1-4, multiple ground insert sounds (only two ground insert sounds are shown) are combined to construct a combination sound system. One of the ground insert sounds functions as a primary set, and other ground insert sounds function as secondary sets. The primary set is connected with the secondary sets. The primary set is connected with an external device 100, and the secondary sets receive the audio signal from the primary set and play the audio signal with the primary set simultaneously. The primary set transmits the audio signal in a transmission manner of 2.4G or 5G or WiFi or FM. Each of the secondary sets decode the audio signal from the primary set and transmit the audio signal to the speaker module 70 which emits sound. The switching button 82 of the circuit board 80 switches the primary set and the secondary sets. The switch 81 turns on or off the speaker module 70. The match buttons 83 match the primary set and the secondary sets.

Accordingly, the stake 10 is inserted into the earth to affix the sounding assembly 30 to the ground, so that the ground insert sound is mounted outdoors easily, quickly and conveniently, thereby simplifying the procedure of assembly. In addition, the user adjusts the position of the ground insert sound freely according to the practical requirement. Further, multiple ground insert sounds are combined to construct a combination sound system. Further, each of the ground insert sounds functions as a primary set and a secondary set, while the primary set and the secondary set cooperate with each other, thereby enhancing the versatility of the ground insert sound.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ground insert sound comprising:
a stake;
a support rod mounted on the stake; and
a sounding assembly mounted on the support rod;
wherein:
the sounding assembly includes:
a base mounted on the support rod;
a sound guide unit mounted on the base;
a speaker module mounted on the sound guide unit;
an outer shell mounted on and located outside of the speaker module;
a circuit board mounted in the base; and
a battery mounted in the base;
the circuit board is connected electrically with the speaker module by conducting wires;
the battery is connected electrically with the circuit board by conducting wires
the base includes a main portion and a mounting tube mounted on a bottom of the main portion;
the sound guide unit includes a reflective portion mounted on the main portion of the base and a plurality of support posts mounted on the reflective portion;
the circuit board is provided with a switch, a plurality of match buttons, and a switching button;
the main portion of the base is provided with a receiving recess which has a bottom wall provided with a plurality of through holes; and
the switch, the match buttons and the switching button extend through and protruding from the through holes of the base.

2. The ground insert sound of claim 1, wherein the main portion of the base has a top having a periphery provided with an annular retaining groove, and the reflective portion of the sound guide unit has a bottom provided with an annular retaining edge retained in the retaining groove of the base.

3. The ground insert sound of claim 1, wherein:
the reflective portion of the sound guide unit has a conical arrangement and is provided with a conical divergence face;
the support posts of the sound guide unit are arranged and distributed evenly around a center of the conical divergence face;
each of the support posts has a height greater than that of the reflective portion; and
the speaker module is provided with a speaker diaphragm corresponding to the conical divergence face of the sound guide unit.

4. The ground insert sound of claim 1, wherein:
at least one of the support posts is provided with a wire hole extending therethrough; and
the conducting wires of the speaker module pass through the wire hole into the base and connect the circuit board.

5. The ground insert sound of claim 4, wherein each of the support posts has a top provided with a screw hole, and the sounding assembly further includes a plurality of set screws each extending through the speaker module and each screwed into the screw hole to affix the speaker module to the support posts of the sound guide unit.

6. A ground insert sound comprising:

a stake;

a support rod mounted on the stake; and a sounding assembly mounted on the support rod;

wherein:

the sounding assembly includes:

a base mounted on the support rod;

a sound guide unit mounted on the base;

a speaker module mounted on the sound guide unit;

an outer shell mounted on and located outside of the speaker module;

a circuit board mounted in the base; and a battery mounted in the base;

the circuit board is connected electrically with the speaker module by conducting wires;

the battery is connected electrically with the circuit board by conducting wires the base includes a main portion and a mounting tube mounted on a bottom of the main portion;

the sound guide unit includes a reflective portion mounted on the main portion of the base and a plurality of support posts mounted on the reflective portion;

the outer shell includes a shell body and a plurality of side plates connected with and located outside of the shell body;

the shell body has a barrel shape and has an opening directed downward;

the shell body has a lower end provided with a first locking groove;

the side plates are located outside of and cover the support posts respectively;

each of the side plates has a lower end protruding from the shell body and provided with a first locking piece;

the speaker module is provided with a second locking piece locked into the first locking groove of the shell body; and the sound guide unit is provided with a second locking groove locked onto the first locking piece of each of the side plates.

7. A ground insert sound comprising:

a stake;

a support rod mounted on the stake; and a sounding assembly mounted on the support rod;

wherein:

the sounding assembly includes:

a base mounted on the support rod;

a sound guide unit mounted on the base;

a speaker module mounted on the sound guide unit;

an outer shell mounted on and located outside of the speaker module;

a circuit board mounted in the base; and a battery mounted in the base;

the circuit board is connected electrically with the speaker module by conducting wires;

the battery is connected electrically with the circuit board by conducting wires the base includes a main portion and a mounting tube mounted on a bottom of the main portion;

the sound guide unit includes a reflective portion mounted on the main portion of the base and a plurality of support posts mounted on the reflective portion;

the stake includes an insert, a pedal mounted on an upper end of the insert, and a mounting head mounted on the upper end of the insert;

the insert includes a pedestal and a plurality of upright plates extending downward from the pedestal and arranged in a radiating manner;

each of the upright plates has a bottom having a tapered shape, with a vertical distance between an outer edge of the bottom of each of the upright plates and a central axis of the insert increasing gradually from bottom to top; and the pedal includes a platform and an oblique plate connecting the platform and the insert.

8. The ground insert sound of claim 7, wherein:

the sounding assembly further includes a receiver, a transmitter and a decoder;

the receiver receives an external audio signal;

the decoder decodes the audio signal; and the transmitter transmits the audio signal that has been decoded.

* * * * *